United States Patent [19]

Hartig et al.

[11] 3,992,867

[45] Nov. 23, 1976

[54] TWO-FOR-ONE TWISTING PROCESS

[75] Inventors: Wolfgang Hartig, Remscheid; Dietrich Berges, Marienheide, both of Germany

[73] Assignee: Barmag Barmer Maschinenfabrik Aktiengesellschaft, Wuppertal, Germany

[22] Filed: Feb. 11, 1975

[21] Appl. No.: 549,089

[30] Foreign Application Priority Data

Feb. 12, 1974 Germany ..... 2406667

[52] U.S. Cl. ..... 57/156; 57/58.54; 57/58.63; 57/58.83

[51] Int. Cl.[2] ..... D01H 7/86

[58] Field of Search ..... 57/58.3–58.38, 57/58.49–58.55, 58.61, 58.63, 58.7, 58.83, 156, 166

[56] References Cited

UNITED STATES PATENTS

| | | | |
|---|---|---|---|
| 1,263,405 | 4/1918 | Groudahl | 57/58.49 X |
| 3,475,892 | 11/1969 | Taira et al. | 57/58.61 |
| 3,613,348 | 10/1971 | Costa | 57/58.32 X |
| 3,648,449 | 3/1972 | Greive | 57/58.83 X |
| 3,726,074 | 4/1973 | Peene | 57/58.36 X |
| 3,830,050 | 8/1974 | Ueda | 57/58.34 |

*Primary Examiner*—Richard C. Queisser
*Assistant Examiner*—Charles Gorenstein
*Attorney, Agent, or Firm*—Johnston, Keil, Thompson & Shurtleff

[57] ABSTRACT

A two-for-one twisting process for twisting two or more individual strands being taken off from separate feed spools or packages arranged in sequence along a common twisting axis at spaced intervals, the strands being doubled or plied together along the twisting axis in a forward take-off direction, wherein the completely plied strands passing the final feed package are deflected and returned backwardly in a rotating balloon pattern by means of at least one rotating twisting disc such that a single balloon envelops each feed package with the plied strands crossing and finally meeting the twisting axis behind each package. The process is useful for plying and twisting all types of filamentary or stranded materials.

5 Claims, 2 Drawing Figures

TWO-FOR-ONE TWISTING PROCESS

Two-for-one twisting processes for doubling and twisting individual filaments taken off from two or more feed bobbins or spools, mounted one behind the other on a stationary spool holder, are already known from German Patent No. (DT-PS) 564,102. Despite all of the advantages of such known twisting processes, problems do arise through the formation of a large balloon, especially in the processing of heavy denier filaments or threads. Balloon limiters and revolving balloon limiters have been unable to make any contribution towards solving this problem, because the very high centrifugal forces and frictional forces generated always produce a marked increase in the tension of the strand to be processed. The same problem exists irrespective of whether the individual strands are unwound from their spools overhead or tangentially; See for example, German published application (DT-AS) 1,274,935 and German Pat. No. (DT-PS) 1,510,160.

One object of the present invention is to provide a two-for-one twisting process in which the centrifugal forces occurring in the balloon are considerably decreased and reduced to a harmless level, even in the processing of thick or heavy strands.

Another object of the invention is to facilitate application of torque in the formation of the balloon by the use of at least one and preferably a number of twisting discs.

Figure 1:
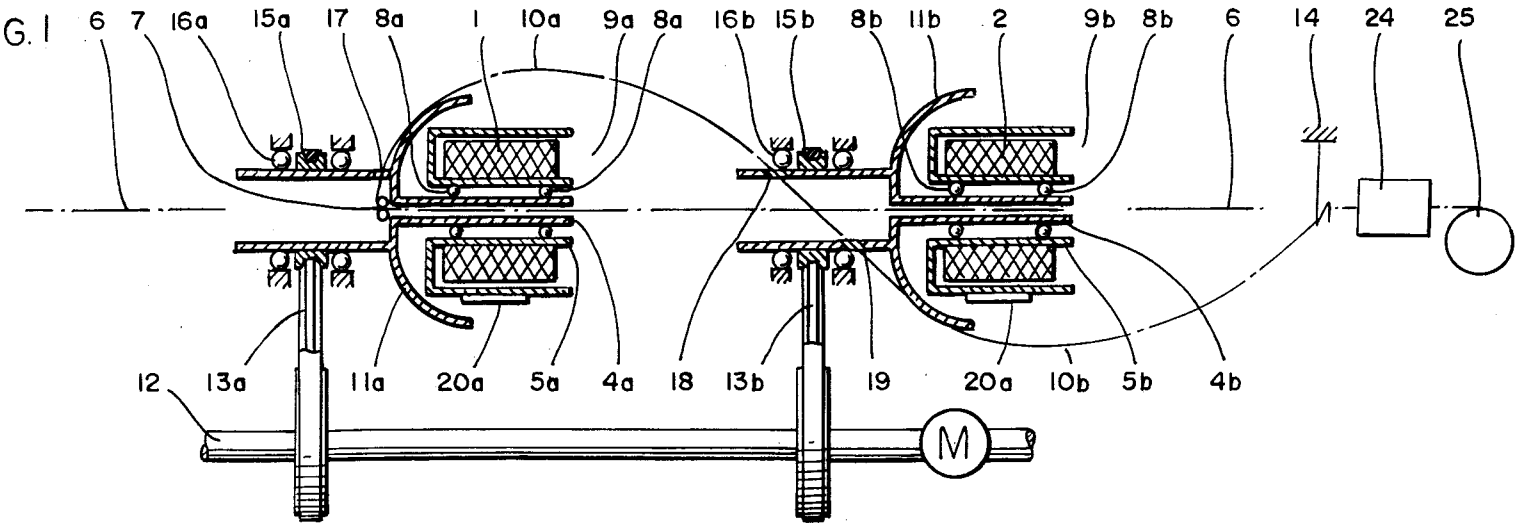
Figure 2:
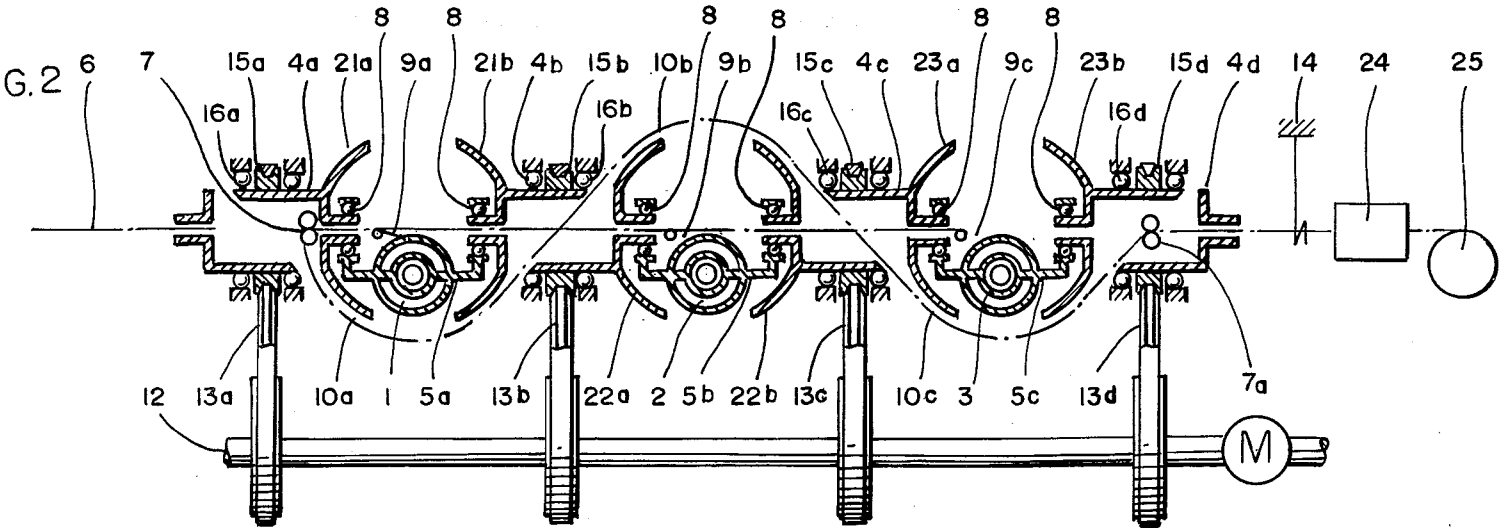

These and other objects and the advantages of the invention will be more clearly understood from the following detailed specification taken with the accompanying drawing in which:

FIG. 1 is a schematic illustration of the two-for-one twisting process with an overhead or axial take-off of individual strands from their feed packages; and FIG. 2 is another schematic illustration of an especially preferred two-for-one twisting process with a tangential take-off of the individual strands.

In accordance with the invention, it has now been found that a substantial improvement can be achieved in a two-for-one twisting process for plying and twisting a plurality of strands by performing the following steps:

Taking off the individual strands from separate feed packages mounted at spaced positions along rotatably driven hollow shafts which define a common twisting axis, guiding the individual strands into and along the twisting axis where they are plied with each other in sequence as they pass each feed package, and deflecting the plied strands outwardly in a rotating return balloon around the final feed package to cross the twisting axis and then outwardly again in a rotating return balloon around each preceding feed package, the plied strands crossing the twisting axis after each feed package until they are drawn off from the balloon rotating around the first feed package.

The deflection of the plied strands outwardly around each feed package in a balloon pattern is effected by at least one rotating head, i.e. a twisting disc, preferably by at least one such rotating head or disc located at the beginning or end portion of each balloon. Especially good results are achieved with a rotating head or disc located both at the beginning and at the end portion of each balloon enveloping a feed package. These rotating heads or discs as described more fully hereinafter are ideally driven at about the same speed of rotation while being maintained in light running contact with the plied strands in the individual balloons.

In the context of the present invention, the term "strand" is applied to any structure with a very considerable length in relation to its cross-section, generally referring to a continuous strand which may be of a single material, a composite material or a combination of several materials. Thus, a strand can be a single monofilament, a thread composed of several filaments or staple fibers, a tape, a ribbon of film, a metallic wire, a cable, a wire cord, a thread cord, a plied or twisted cord, etc. Although the invention is especially applicable for twisting large denier textile filaments, threads or the like, it should not be limited to these particular types of strands.

The advantage of the process according to the invention is that it only allows the formation of relatively small balloons which, in view of their limited dimensions, do not envelop all the strand feed packages, but only have to be adapted to envelop the individual feed packages. Another advantage is that the balloon does not have to be supported in any way.

Referring now to the drawing, FIG. 1 shows the strand packages 1 and 2 in the form of rotatably mounted feed spools with high denier filaments wound onto them. The strand feed packages are mounted for rotation on the holders 5*a* and 5*b*, for example by means of suitable roller bearings 8*a* and 8*b* supported on the hollow shaft segments 4*a* and 4*b*, but these packages are held in a certain position by conventional means such as weights 20*a* and 20*b*. The feed packages or spools 1 and 2 are thus freely rotatable but tend to oscillate freely and only slightly on the twisting axis 6, i.e. so as to remain in an almost fixed position, due to the weights 20*a* and 20*b*.

The hollow shafts 4*a* and 4*b* are then separately mounted for rotation in the bearings 16*a* and 16*b*. The hollow shafts are driven with motor M at the same rotational speed by the main drive shaft 12 through belts 13*a* and 13*b* in conjunction with pulleys 15*a* and 15*b*.

The dish-shaped twisting discs 11*a* and 11*b* are mounted on the individual hollow shafts for rotation therewith. It is pointed out that the twisting disc 11*b* can be omitted, although it is preferably used for carrying out the process together with disc 11*a* in directing the balloon paths 10*a* and 10*b*.

The filaments 9*a* and 9*b* are initially taken off overhead or axially and guided into the twisting axis 6 and along this axis through the hollow shafts 4*a* and 4*b*. It is apparent from FIG. 1 that the filaments 9*a* and 9*b* are plied or doubled inside the hollow shaft 4*a*. The plied filaments are then guided through the pair of nip rollers 7 acting as a twist stop means so as to change direction at these rollers and pass outwardly through the opening 17 onto the twisting disc 11*a*. The filament is entrained by the twisting disc 11*a* so that it forms the balloon 10*a*. The balloon 10*a* in its reentrant path passes through the opening 18 in the shaft 4*b* to cross the twisting axis 6.

The plied filaments or strands are guided substantially in a straight line through the shaft section 4*b* and its openings 18 and 19. At this same time, this straight line crosses the path of the component filament or strand 9*b* with a certain lateral clearance so that the component strand 9*b* and the completely plied strands 10*a* do not come into direct contact with one another. Behind the opening 19, the plied strands which are preferably supported by the twisting disc 11*b* form another balloon which enters into the thread guide 14 situated directly on the twisting axis. The plied and twisted strands 10*b* are then taken up on the winding spool 25.

The two-for-one twisting spindles illustrated herein can be equipped with the usual fittings such as filament brakes, flyers, etc. After-treatment devices 24 may be arranged at the end of the balloon, especially in cord production, the object being to keep the twisting of the strands as uniform as possible and to produce a final twist-free cord or the like.

FIG. 2 illustrates an especially preferred embodiment of the two-for-one twisting process in which the feed spools 1, 2 and 3 are of the type from which the strands 9*a*, 9*b* and 9*c* are tangentially taken off over the adjacent axial guide pins so as to be plied as they are drawn together along the twisting axis forwardly to the nip rolls 7 or the like. The feed spools are mounted on the spool carriers or holders 5*a*, 5*b* and 5. Mounting of the spool holders on the hollow shaft segments 4 ensures that the spool holders do not co-rotate, i.e. that these spool holders and their feed spools are free to oscillate on the bearings 8 as a so-called cradle or rockingly supported feed means. Suitable apparatus of this type requiring only minor modification is to be found in the copending U.S. application, Ser. No. 542,198, filed Jan. 20, 1975 by Berges et al. There is further incorporated herein by reference the disclosure of the copending U.S. application, Ser. No. 548,982, filed Feb. 11, 1975, by W. Hartig et al and especially directed to apparatus for the process of the present invention. Particular details of the twisting machines may be directly taken from both of these copending applications.

The hollow shaft segments 4*a* to 4*d* are driven by a central drive shaft 12, the belts 13*a* to 13*d* and suitable pulleys 15*a* to 15*d* (in the same way as shown in FIG. 1 for example).

In the embodiment shown in FIG. 2, three filaments or strands are plied and twisted with one another. As shown in FIG. 1, the embodiment of FIG. 2 also includes the twisting discs 21*a*, 22*a* and 23*a* at the beginning of each individual balloon 10*a*, 10*b* and 10*c*. In addition to this, however, twisting discs 21*b*, 22*b* and 23*b* are provided at the end or terminal portion of each balloon in the return path of the plied strands as they cross or finally meet at the twisting axis 6, e.g. at guide rolls 7*a*. By virtue of this arrangement of the twisting discs, the torque to be applied to the completely plied strands can be divided up between all of the discs so that introduction of the twist is made considerably more uniform.

In other respects, the embodiment shown in FIG. 2 substantially corresponds to the structure illustrated in FIG. 1, it being understood that the reference numerals identify the same parts with respect to their function only and that substantial variations can be made in the construction and arrangement of these parts while still carrying out the process of the present invention. For example, it is pointed out and especially emphasized that the twisting discs do not have to have the shapes or configurations illustrated in the exemplary embodiments. They can also be in the form of flyers with filament guide eyes or in the form of pots in which the filament or strand is internally guided. Guide elements such as nip rolls 7 or 7*a* rotate with the hollow shafts to which they are connected while the guide pins associated with the feed spool delivery at 9*a*, 9*b* and 9*c* remain in a substantially fixed position.

The process of the present invention is not to be construed as one which must be carried out with the preferred apparatus disclosed in this application. The principles of this process are widely applicable to other known apparatus or such twisting apparatus which requires only slight changes to be adapted to the present process. On the other hand, special advantages are achieved when the twisting discs are maintained in relatively light running contact as both guide and torque-imparting surfaces rotating within the balloon path of the plied strands. Very uniform operation is possible under these conditions, especially where the twisting discs are located both over the beginning and end portions of each balloon and the plied strands run from disc to disc in a relatively straight and unobstructed path through the hollow shaft between each feed position.

The process is readily carried out with heavier denier textile filaments or strands such as nylon, polyethylene terephthalate or the like to achieve a multi-ply twisted cord or rope which may be further processed or treated in a conventional manner to heat-set the individual monofilaments or threads or to perform textile operations such as weaving, knitting, braiding or the like. Wire ropes or cables are also produced in a very satisfactory manner, even at very high linear strand speeds. In all cases, one can readily achieve a highly uniform plied and twisted strand product.

The invention is hereby claimed as follows:

1. A two-for-one twisting process for twisting a plurality of individual strands which comprises:

taking off the individual strands from separate feed packages mounted at spaced positions along rotatably driven hollow shafts which define a common twisting axis;

guiding the individual strands into and along the twisting axis where they are plied with each other in sequence as they pass each feed package; and deflecting the plied strands outwardly in a rotating return balloon around the final feed package to cross the twisting axis and then outwardly again in a rotating return balloon around each preceding feed package, the plied strands crossing the twisting axis after each feed package until they are drawn off from the balloon rotating around the first feed package.

2. A process as claimed in claim 1 wherein the plied strands are deflected outwardly in said balloon around each feed package by at least one rotating head.

3. A process as claimed in claim 1 wherein the plied strands are deflected outwardly in said balloon around each feed package by at least one rotating head located on said twisting axis in at least one of the positions immediately preceding and following said feed package in the direction of travel of the strands.

4. A process as claimed in claim 1 wherein the plied strands are deflected outwardly in said balloon around each feed package by rotating heads located respectively in positions both immediately preceding and following said feed package in the direction of travel of the strands.

5. A process as claimed in claim 4 wherein all of the rotating heads are driven at the same rotational speed while being maintained in light running contact with the plied strands.

* * * * *